US005848735A

United States Patent [19]

Eddy et al.

[11] Patent Number: 5,848,735

[45] Date of Patent: Dec. 15, 1998

[54] WATER COOLER ASSEMBLY HAVING INJECTION-MOLDABLE SHELL AND JOINT THEREIN

[75] Inventors: John W. Eddy, Riverside; Kelley S. Needham, Yorba Linda; Jeffrey L. Harlan, Corona, all of Calif.

[73] Assignee: Kel-Jac Engineering and Plastic Sales, Inc., Riverside, Calif.

[21] Appl. No.: 724,162

[22] Filed: Sep. 30, 1996

[51] Int. Cl.[6] ..... B67D 5/06

[52] U.S. Cl. ..... 222/185.1; 312/265.5

[58] Field of Search ..... 222/185.1, 146.6; 312/204, 205, 257.1, 263, 265.5, 265.6, 271, 272

[56] References Cited

U.S. PATENT DOCUMENTS

| | | | |
|---|---|---|---|
| 3,704,925 | 12/1972 | Scott | 312/228 |
| 3,868,153 | 2/1975 | Sholtes | 312/236 |
| 5,528,810 | 6/1996 | Eddy et al. | 29/401 |
| 5,645,331 | 7/1997 | Eddy et al. | 222/185.1 X |

*Primary Examiner*—Gregory L. Huson
*Attorney, Agent, or Firm*—Oppenheimer Wolff & Donnelly, LLP

[57] ABSTRACT

A shell for a water cooler has two side sections and a front section. The side sections slide-connect with the front section and lock in place at corner joints, thereby forming an essentially one-piece shell. The shell may be economically fabricated with only two molds (one for the side sections and one for the front section) and with only the slide-connect step.

18 Claims, 4 Drawing Sheets

13
2
12
20
45
11
21
24
65
10
36
26
51
15
16
2
20

FIG. 6.
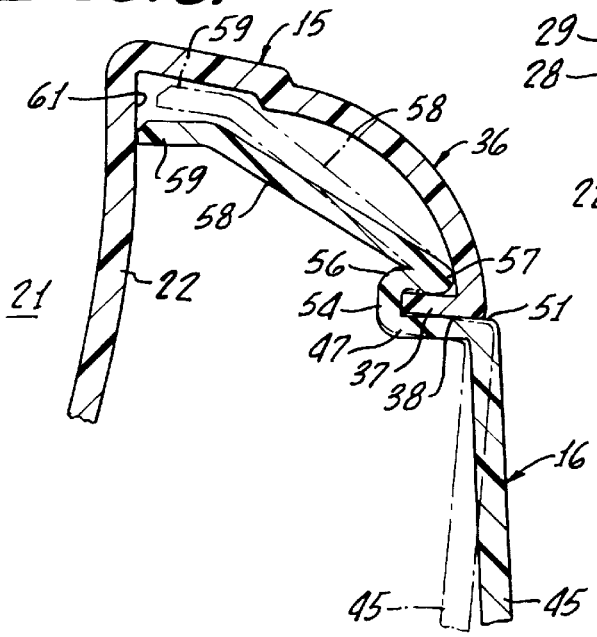
FIG. 5.
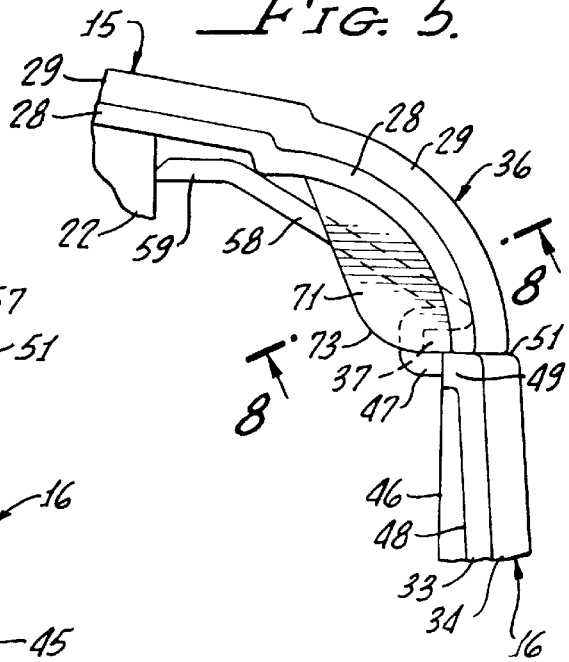
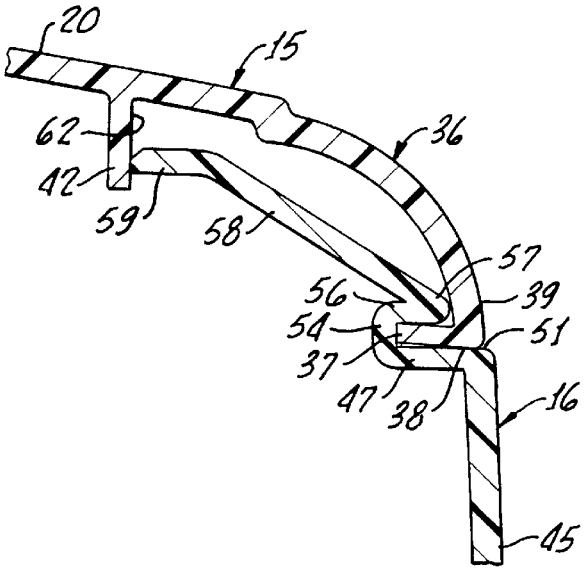
FIG. 7.
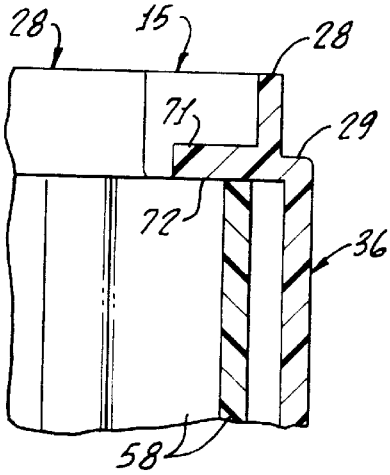
FIG. 8.

WATER COOLER ASSEMBLY HAVING INJECTION-MOLDABLE SHELL AND JOINT THEREIN

BACKGROUND OF THE INVENTION

The shells of domestic water coolers can be made in one piece, by blow molding. However, blow molding has disadvantages, for example in that the shell does not have the high-quality appearance that characterizes a shell that is injection-molded.

There exist water cooler shells that are injection-molded and have several pieces. These, however, are characterized by certain disadvantages, including one or more of the following:

(1) Different parts of the top edge are not at the same elevation, and do not assemble well with the cover.

(2) There are more pieces than desired, which do not assemble as fast as desired.

(3) It is not possible or practical to remove and replace only one of the pieces during refurbishing of the water cooler shell after a period of use.

(4) The pieces do not—during assembly to the frame—have the characteristics of one-piece shells. Instead, until there is final assembly to the frame of the cooler, the shell components tend to move relative to each other. This is at worst maddening, and at best inconvenient, to the persons assembling the shell to the frame.

(5) The shell components do not always fit tightly relative to the frame, but instead tend to move somewhat and therefore not create the look and feel of a solid one-piece shell that has the cover properly mounted and that is firmly anchored to the frame.

(6) There are often visible cracks between adjacent shell components, which signal to the public that the shell is not one-piece.

Plural-piece shells for water coolers have advantages, for example, the ability to be shipped unassembvled in small spaces. It is desired to have a shell that has advantages of plural-piece shells but not their disadvantages.

SUMMARY OF THE INVENTION

In the present specification and claims, the cover is not treated as being part of the "shell".

The present shell is capable of being—and very preferably is—injection-molded. It has only three pieces, and is molded using only two molds in the preferred embodiment. Thus, the front of the shell is made in one mold and the two sides of the shell are made in the other mold.

The invention is such that the two sides (side sections or side panels) readily slide-connect to opposite edges of the shell front (front section of front panel). As soon as the sliding action is completed, the shell sides snap-lock to the shell front, making it difficult but (in the preferred form) not impossible to separate one or the other (or both) of the sides from the front. The "lock" prevents either side from moving upwardly relative to the front, during final stages of assembly.

It follows that, very quickly, the shell has been pre-assembled into a seemingly one-piece shell, having all the advantages thereof in that it does not tend to partially or entirely become disassembled when manipulated prior to or during the subsequent assembly to the frame.

It is then merely necessary to take the seemingly one-piece shell and mount it around the previously-assembled frame (and other internal and/or rear components) of the cooler. The shell is then anchored to the frame and the cover is mounted thereon.

The joints that connect the front edges of the sides to the side edges of the front are, in accordance with one aspect of the invention, not fully tight and crackfree during the assembly process. However, the sides are pivoted relative to the front through small angles during the final stages of the assembly to the frame, which is caused to substantially or entirely eliminate all cracks between sides and front and create the appearance of a one-piece shell.

The structure recited in the preceding paragraph relates not only to the shell in its entirety but to the joints between the sides and the front. Such joints also include means forming part of the front to cause simple tongue-in-groove combinations to remain assembled. Such means include, in the preferred form, side regions of the alcove that contains the faucets.

BRIEF DESCRIPTION OF THE DRAWINGS

FIG. 5 is an enlarged fragmentary horizontal sectional view of one of the front corners and corner joints of the shell, as viewed from station 5—5 in FIG. 2;

FIG. 6 is an enlarged fragmentary horizontal sectional view on line 6—6 of FIG. 2, and showing in phantom line the position of a side region prior to assembly of the shell with the frame;

FIG. 7 is an enlarged fragmentary horizontal sectional view on line 7—7 of FIG. 2; and FIG. 8 is a fragmentary vertical sectional view on line 8—8 of FIG. 5.

DETAILED DESCRIPTION OF THE PREFERRED EMBODIMENT

Figure 1:
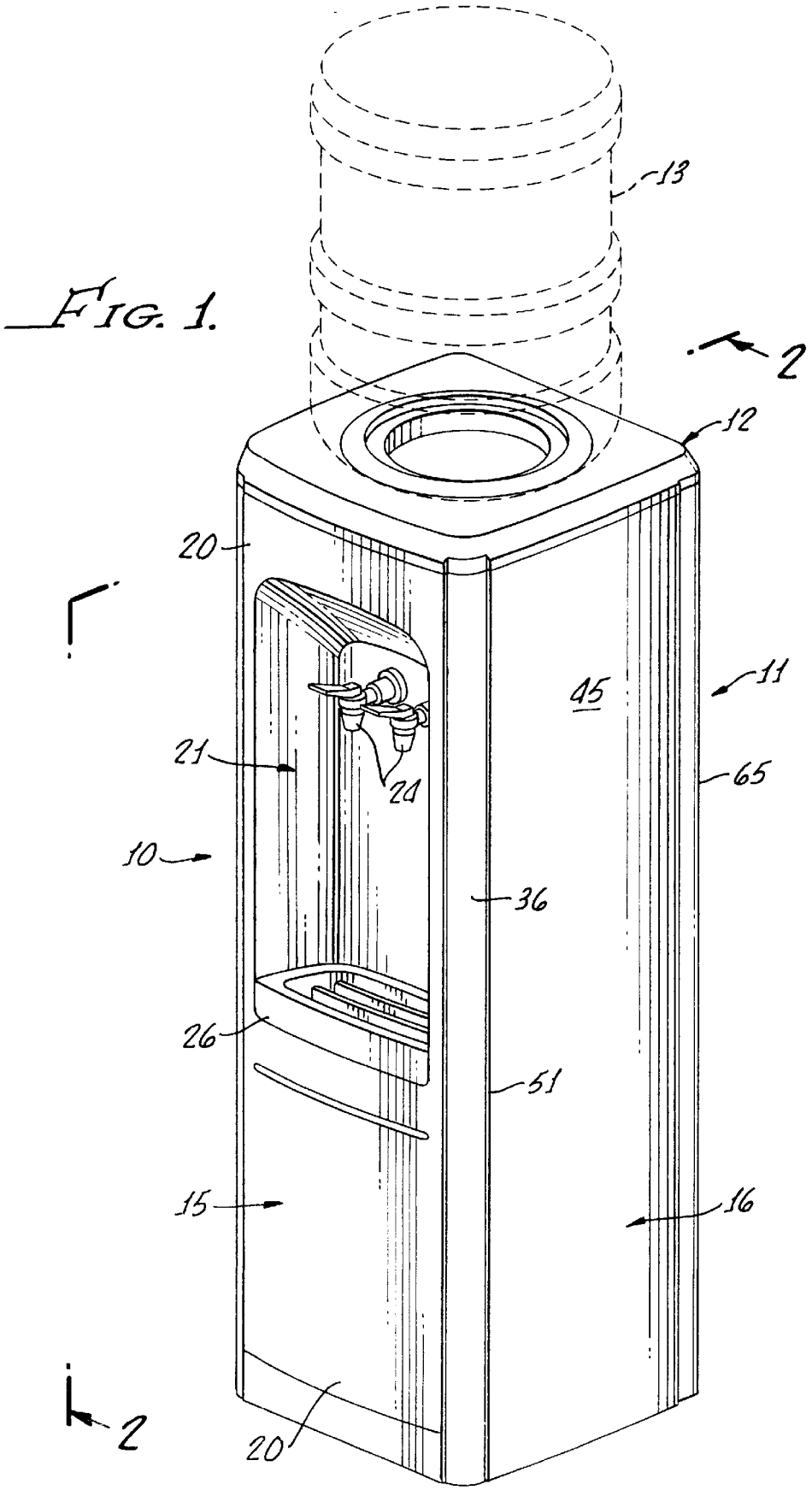
FIG. 1 is an isometric view showing the present shell, in one of the many decorative shapes it could have, assembled into a domestic water cooler.

Referring to FIG. 1 the domestic water cooler 10 has a synthetic resin shell 11 over which is mounted a cover 12. A bottle 13 sits on the cover in the conventional position.

Shell 11 is U-shaped in horizontal section, having a front section 15 (the base of the U) and two side sections 16 (the arms of the U).

Each side section 16 is symmetrical about a horizontal medial plane (unshown). The front section 15, on the other hand, is symmetrical about a vertical medial plane (unshown) which is parallel to the main bodies of sides 16. Because of these symmetries, the showing of only one front corner (as in FIGS. 2 and 4, for example) serves also as a showing of the other front corner.

The front section 15 and the side sections 16 are injection-molded, in the greatly preferred embodiment, and extend all the way from the cover 12 to adjacent the floor on which the water cooler is supported.

Figure 2:
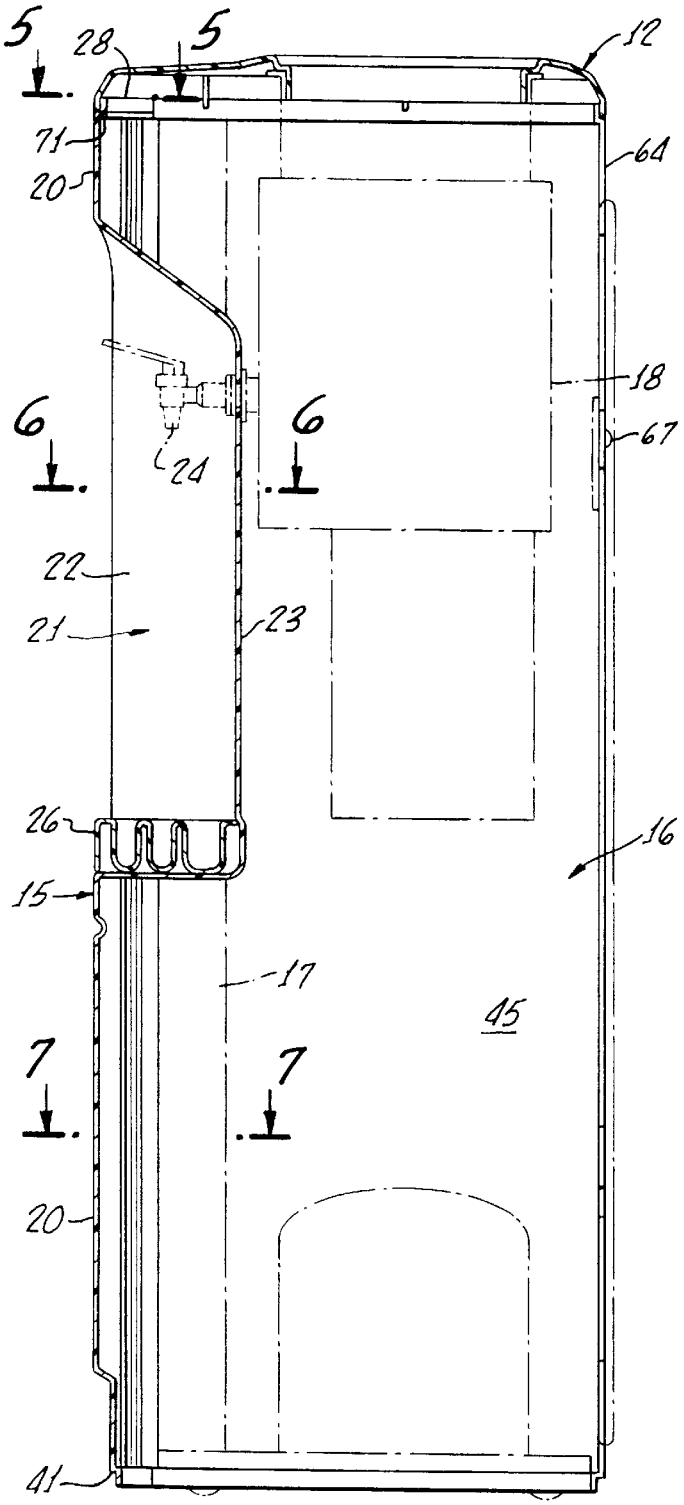
FIG. 2 is a longitudinal sectional view on line 2—2 of FIG. 1, and showing in phantom lines portions of the interior of a typical water cooler.
Figure 3:
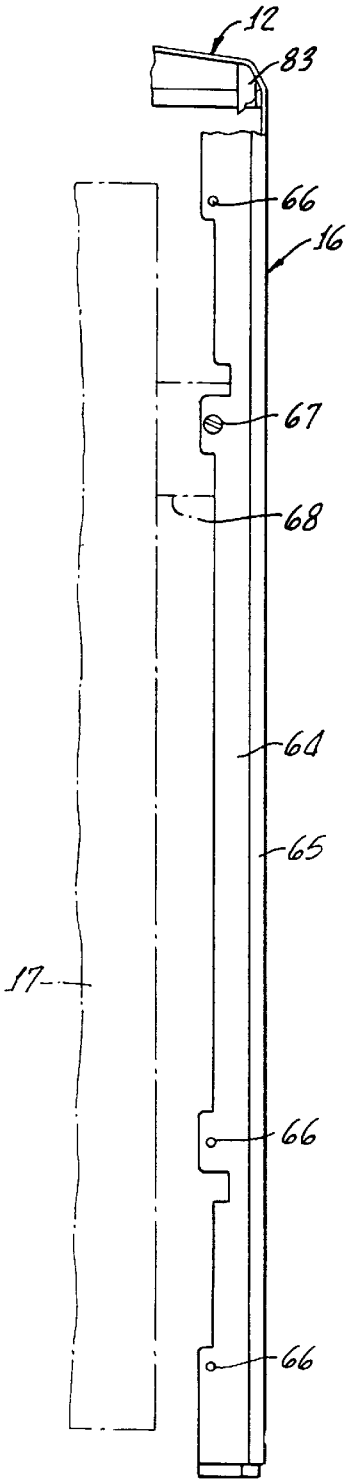
FIG. 3 is a fragmentary elevational view illustrating the rear edge region of one of the shell sides, as viewed from the right in FIG. 2.

The frame and interior of the water cooler are indicated schematically in phantom line in FIGS. 2 and 3. It is to be understood that the frame provides a support to which the side sections 16 are anchored, as indicated below. The frame is given the general reference numeral 17, and certain other components of the interior are indicated at 18.

Proceeding to a description of front section 15, this comprises a panel 20 that extends for substantially the full length of the cooler, and that has a large alcove, recess, or depression 21 in the upper portion thereof. Alcove 21 has side walls 22 (FIGS. 2 and 6) and a back wall 23 (FIG. 2), the latter being penetrated by one or more faucets 24 that extend inwardly into interior components 18 of the water cooler.

As best shown in FIG. 6, the alcove side wall 22 is spaced away from the side section 16 opposite thereto. At least at its region which is relatively near the front of the shell 11, side wall 22 of the alcove is vertical.

Front section 15 has a horizontal top edge 28 (FIG. 4) that is indented rearwardly or inwardly by a narrow ledge 29 (FIG. 5). Such edge 28 and ledge 29 are, as described in detail below, respectively caused to be in the same horizontal planes as the top edge 33 and adjacent ledge 34 of each side section 16, reference being again made to FIGS. 4 and 5. Furthermore, the extreme top edge 28 of front section 15 is caused to register, at its ends, with the extreme top edge 33 of each side section 16. Ledge 29 of front section 15 is caused to register, at its ends, with the ledge 34 of each side section 16. The result is that the cover 12 fits substantially perfectly, as described below, over top region of shell 11, substantially the same as if the shell were a one-piece shell instead of a three-piece shell.

At each of its edges, front section 15 has corners 36 that extend around approximately 90°. Reference is made to FIGS. 1 and 5–7.

Starting just below the horizontal top ledge 28, and extending vertically downwardly all the way down to the bottom of front section 15, at the edge of the corner, is an inwardly-extending narrow flange 37 (FIGS. 5–7). Flange 37 has a vertical face 38 that is generally parallel to panel 20 of front section 15. Preferably provided on face 38 near the corner where such face 38 meets the exterior surface 39 of corner 36 is a thin bead (not shown). By "thin" it is meant that the dimension of the bead in a direction perpendicular to face 38 is small.

Except for subsequently described stops, the remaining element of front section 15, except for a ledge 41 at the bottom (FIG. 2) that generally corresponds to ledge 29 at the top, is a flange 42 (FIG. 7). Such flange 42 extends vertically downwardly from the bottom of each side wall 22 of alcove 21—forming a downwardly extending extension of the portion of such side wall 22 that is relatively near front panel 20.

Front section 15, and side sections 16, are (as above stated) very preferably injection-molded, the presently preferred synthetic resin being polypropylene.

The Side Sections 16

Each side section 16 has a large panel 45 at the top edge region of which is the above-indicated horizontal ledge 34 and horizontal top edge 33. A brace 46 (FIG. 4) is provided to increase rigidity, there being such a brace both at the top and bottom edges of panel 45.

At the forward edge of each panel 45 is joint means that cooperates with joint means on front section 15 to form a joint therewith. At the rear edge of each panel 45 is means to form a joint with frame 17 of the water cooler. These joint means are separately described below.

Figure 4:
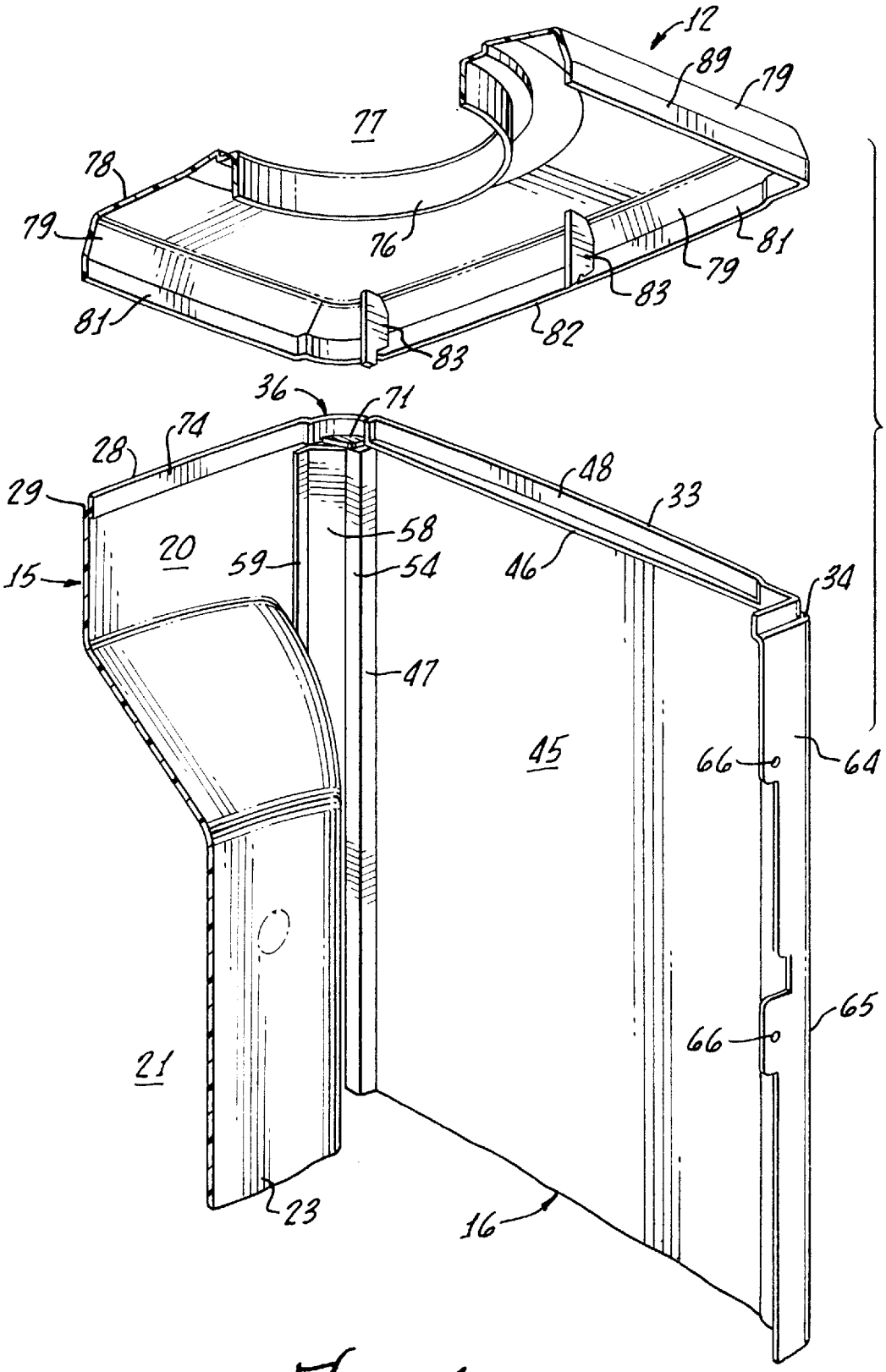
FIG. 4 is an interior fragmentary isometric view showing an upper front portion of the shell and showing a joint region between a side and the front of the shell, and also showing the corresponding portion of a cover to be mounted over the shell.

At the front edge of panel 45 is a narrow vertical wall 47 (FIGS. 6 and 7) that extends inwardly at a substantially right angle to panel 45. Wall 47 does not go all the way to the top (or the bottom) of side section 16, terminating instead generally at the horizontal plane of ledge 34 (FIG. 4). A vertical lip 48 extends upwardly from ledge 34 (and brace 46), having the above-indicated top edge 33.

At the front end of lip 48, and "bent" at a right angle thereto, is a thickened forward end portion 49 (FIG. 5). Such portion 49 has a forward face that is vertical and coplanar with the forward vertical surface (face) of the narrow vertical wall 47. Such faces are present at what is termed vertical crack 51 in reference to FIGS. 1 and 5–7. The rearward face of the inwardly-extending flange 37, which is coplanar with the rearward face of corner 36 of front section 15, forms the opposite wall of the crack 51.

The described narrow vertical wall 47 connects to a wall portion 54 (FIGS. 6 and 7) that extends forwardly for a distance sufficiently great to receive the thickness of flange 37 on corner 36. Then, further forwardly, there is formed an outwardly-extending wall portion 56 (FIGS. 6 and 7), the rearward surface of which is generally parallel to the forward surface of wall 47. Wall portion 56 merges with an acute-angle corner portion 57 which, in turn, merges with a flange or wing 58 described below.

As shown in FIGS. 6 and 7, flange 37 of corner portion 36 extends into a groove defined by the interior walls or portions 47, 54, 56 and 57. This is caused to be not a tight fit but an easy one. On the other hand, it is not so loose as to prevent or hinder the couple action, or binding action, described below.

The sizes of the parts are caused to be such that flange 37, the male element, extends into the groove until wall portion 54 (FIGS. 6 and 7) is engaged and/or until the outer corner of acute-angle corner portion 57 is engaged by the inner surface of corner portion 36.

The described flange (tongue)-and-groove joint portion is a major part of the joint means between the forward corner of side section 16 and an outer corner of front section 15. The remaining major portion consists of the flange or wing 58 and the elements that cooperate with the outer end thereof, which outer end is preferably somewhat bent (FIGS. 5–7) and is indicated by reference numeral 59. The flange or wing 58 extends outwardly from the groove portion at the forward end of side section 16 at an obtuse angle, as illustrated, which means that injection molding is made simple. The outer end 59 is "bent" so as to be generally perpendicular to the elements with which it cooperates, and which are next indicated.

These elements that cooperate with wing 58/59 are, in the preferred form of the invention, the above-indicated side wall 22 of alcove 21 (FIG. 6) and the vertical flange 42 that extends down from such side wall of alcove 21 (FIG. 7). The dimensions are so chosen that there is a sliding fit between the tip of wing 58/59 and the cooperating outer side surfaces 61–62 (FIGS. 6 and 7) of wall 22 and flange 42. This slide fit is such as to keep the groove defined by elements 47, 54, 56, and 57 closely mated with flange or tongue 37, as shown in FIGS. 6 and 7.

The relationships are such that the outer side surface of panel 45 of side section 16 merges generally with the outer surface 39 of corner 36, which corner 36 in turn merges with the outer surface of front panel 20.

Proceeding next to a description of the joint means at the rear edge of each side section 16, this comprises a narrow rear wall or flange 64 (FIGS. 2–4) that is perpendicular to side panel 45. It connects to the side panel at a corner 65

(FIG. 4). At its upper (and its lower) end, rear wall or flange 64 has an edge, a lip, and ledge corresponding to and connecting to those 33, 48, and 34 previously described.

Formed through relatively thick portions of rear wall or flange 64 are vertically spaced screw (or bolt) holes 66, two of which are shown in FIG. 4. These are precisely located as by being formed during the molding process. Screws 67, one of which is shown in FIG. 3, extend through the holes 66 into screw holes associated with the frame of the cooler as (for example) by being formed through ears 68, only one of which is shown in FIG. 3.

It is emphasized that the frame 17, which sits on the floor, forms the anchor or foundation for the shell. The screw holes (not shown) in the frame 17 are located at predetermined elevations. The relationships are such that when screws 67 are introduced through screw holes 66 in rear wall or flange 64, the rear walls 64 will be anchored to the frame at predetermined elevations. The rear walls on both sides of the cooler, that is to say on both sides of front section 15, are at the same elevations as each other.

Description of the Method (Operation) of the Parts As Thus Far Described

Let it be assumed that a frame and other interior components of the cooler 10 have been assembled and are supported vertically on the floor. Let it also be assumed that the two side sections 16 and front section 15 have been injection-molded and are ready to be assembled (as is cover 12 described below).

It is an extremely simple and fast thing to assemble the front corner portion of each side section 16 with a side corner portion of front section 15. This is done one side section at a time, as follows:

With front section 15 in any convenient position, for example, vertical, the lower-front edge portion of a vertically-oriented side section 16 is brought into proximity with an upper corner portion of the front section. The side section 16 is caused to be substantially perpendicular to the front section 15. Then, and referring to FIG. 6, the groove-forming portions 47, 54, 56 and 57 are mated with flange 37, there being at this time only a few inches of overlapping of the lower part of the side section relative to the upper part of the front section.

It is emphasized that such mating is easy to do because the flange or wing element 58/59 does not engage anything—the alcove and its side wall 22 being far below the side section at this time because the upper region of the alcove 21 is spaced far below the upper edge of the front section. It is then a simple and easy matter to move side section 16 downwardly while maintaining flange 38 in its associated groove.

As soon as the lower edge of side section 16 reaches the elevation of the upper part of alcove 21 and its side wall 22 (FIG. 6), tip 59 starts moving along the surface 61 of alcove wall 22. Accordingly, from then on the mated relationship between flange 37 and the associated groove-forming elements is automatically maintained by engagement of the end of wing tip 59 with the side surface 61 of alcove wall 22. Side section 16 is quickly slid downwardly to a much lower elevation at which the end of wing tip 59 engages surface 62 of flange 42 (FIG. 7).

After the few seconds required to slide the lower corner of side section 16 downwardly until surface 61 of alcove wall 22 is engaged, the operator may very quickly slide side section 16 all the way to the bottom so that it is registered with front section 15.

The region of flange 58/59 above alcove 21 (FIG. 4) is cantilevered upwardly from lower regions of flange 58/59. This is a high-strength relationship, especially since flange 58/59 is wide.

The process is repeated for both right and left side sections 16 relative to front section 15, to result in the U-sectioned shell 11 referred to in the first portion of this specification. The joints between the arms (side sections) of the shell and the base (front section) of the shell are complete but not in their final positions as yet. This is because the angle of flange 37 (and other factors) are so selected that after the described assembly of the arms and base of the U have occurred, the side panels 45 are not parallel to each other (solid lines in FIG. 6) but instead converge rearwardly relative to each other (phantom lines shown in FIG. 6). In other words, there is some degree of rearward convergence of side panels 45 towards each other in a direction away from front section 15. Because the flanges or wings 58 are connected to side panel 45, they are in a position shown in phantom line in FIG. 6, and which corresponds to the phantom-line positions of the side panels 45.

Because of stop or shelf structure described subsequently, the side sections will not move up—relative to the front section—during the following assembly steps.

The next step in the method is to mount the preassembled shell relative to the frame. This is done by merely moving the side sections in a rearward direction around the frame (and associated components) so as to embrace it. The screws 67 are then inserted into the holes 66 (FIG. 3) and into the holes in the frame in order to anchor each rear wall or flange 64 and, accordingly, both entire side sections 16 to the frame. Stated in another manner, the rear regions of side sections 16 are anchored to the frame by means of the screws and screw holes and associated flanges or walls 64. The front section 15 is not directly anchored to the frame but extends between the forward corners of side sections 16 and keeps them rigidly spaced apart from each other. In this connection, it is pointed out that the faucets 24 (FIGS. 1 and 2) are connected to the interior of the cooler but the faucets cannot be, and are not, counted upon to secure the shell in the desired relationship to the frame.

During the described mounting operation, the side panels 15 (FIG. 6) inherently pivot away from each other through small angles, for example, from the phantom-line position, shown in FIG. 6, to the solid line position shown therein. This creates a pivot action, or couple action, at each tongue-in-groove joint so that there is pivoting about the inner region of each flange 37.

As a result of each of these couples, there is a close or pinching action that occurs at each crack 51, which reduces to a minimum the gap between the above-described opposing faces at each crack 51. The result is that the appearance of a solid one-piece shell is created—there being very little or no space between the opposed faces at each crack 51.

In the described very simple manner, therefore, there is caused to be relative longitudinal sliding assembly of a side section to a front section with relatively low friction, followed by pivotal action (FIG. 6) which greatly increases friction (and narrows the crack) by creating pinching or substantial contact at especially the outer regions of the faces in crack 51. By "outer" is meant, for example, the right region in FIG. 6.

Achieving Horizontal Alignment and Facilitating Shell Handling

The portions of the apparatus (and method) particularly adapted to achieve horizontal alignment, that is to say, to cause the extreme upper edges 28 and 33 of front section 15 and side sections 16 to be at the same level, will now be described. Such portions of the apparatus also serve to prevent the front from shifting down relative to the sides— and the sides from shifting up relative to the front—during and after assembly to the frame.

With certain desirable synthetic resin materials, there are somewhat different amounts of shrinkage during different injection molding runs, which means that the side sections 16 are not necessarily the same lengths nor is the front section 15 necessarily the same length as the side sections. Applicants have discovered a simple solution for this, namely:

(1) firmly anchor the side sections 16 to the frame so that the extreme top edges 33 of the side sections 16 are at the desired known, identical elevation.

(2) "hang" front section 15 on both side sections 16 at a precise, known elevation relative to such side sections and not necessarily relative to the frame.

It is pointed out that, for example, if one of the side sections is somewhat longer than the other, the difference is made up at the extreme bottom of the shell where it is not noticeable. The top edge (33) of each side section is caused to be at the same elevation as the top edge (33) of the other side section. Furthermore, the "hanging" of the front section is such that top edge 28 of the front section is at precisely the same elevation as top edge 33 of each side section in substantially all instances, and even despite vibration and other factors occurring during trucking of the water coolers to the home or office where will they be used.

To achieve precise hanging of the front section 15 on the two side sections 16, stops or shelves 71 are integrally molded on front section 15—reference being made to FIGS. 5 and 8.

As best shown in FIGS. 4 and 5, stops 71 (shelves 71) have several characteristics. One is that they are located in the notches that are above the upper ends of wings (flanges) 58 and are below the upper edges 28 when the side sections and front section are in assembled relationship. Another is that the elevations of the horizontal lower surfaces of the stops, such surfaces being numbered 72 in FIG. 8, are precisely determined in such manner that when such surfaces 72 rest on the horizontal upper edges of wings (flanges) 58, the upper edge 28 of the front section is at the same elevation as the upper edges 33 of the side sections. Furthermore, very preferably, the stops or shelves are not so large that it is not possible to bend wings 58 from beneath them in order to disassemble one side section 16 from the front section 15 while the shell is mounted on the frame (except that such one side section 16 is unscrewed) so that the side section may be removed without removing the front or the other side section. This facilitates refurbishing when the cooler is refurbished after a period of use.

During the initial sliding assembly of each side section with the front section, flange 58 rubs along a protuberant forward edge 73 (FIG. 5) of stop 71. This, however, does not interfere with slide assembly because of the substantial and cantilevered length of flange 58/59 that projects upwardly above the wall of the alcove. As soon as the upper end of flange 58/59 moves down below surface 72 of stop 71, the flange 58/59 snaps outwardly to its position below stop 71, which positively prevents upward movement of the side sections—and downward movement of the front section, during and after assembly. One benefit is that the assembled three sections act as one during assembly with the frame, thus facilitating assembly.

As a last step in the assembly method described above, the operator forces front section 15 down until it is sure that the lower surfaces 72 of stops 71 at both front corners of front section 15 are seated on the horizontal upper surfaces of flanges or wings 58 (FIGS. 5 and 8). Gravity and friction will thereafter assure that the engaged relationship between stops 71 and the upper ends of wings 58 is maintained. For example, if the cooler is on a truck traveling a long distance over not-smooth roads to the end user, the jiggling causes any "loose" element to move downwardly. However, front section 15 cannot jiggle downwardly because it is effectively prevented from so doing by the engaged relationship between stops 71 and the upper ends of wings 58.

The Cover and Its Mounting

As illustrated in FIG. 4, each side section has a lip 48 extending vertically between the top edge 33 and the ledge 34. Also, front section 15 has a lip 74 that extends vertically between the above-described top edge 28 and the ledge 29 of the front section. Because of the principles described above, and including the stop portion or shelf 71, the lip 48/74 and top edges 28/33 all cooperate in a continuous manner substantially as if the shell were a one-piece molding instead of a three-piece assembly. The cover 12, next described, therefore fits perfectly on the rim elements.

Referring next to the cover 12, it has the usual central neck and opening for the water bottle 13 (FIG. 1), the neck being numbered 76 and the opening 77. The top wall 78 of cover 12 extends outwardly from opening 77 to a substantially rectangular side wall 79. Each side wall 79 has at its lower edge a downwardly-extending exterior lip 81 that is shaped identically to the above-described lip 48/74 except that it is somewhat larger and therefore fits outwardly thereover in telescoping relationship. Bottom edge 82 is provided on such element 81 and can seat on the described ledge 29/34 of the shell.

Accordingly, it is merely necessary to set the cover 12 on the upper edge of the shell, with bottom edge 82 on ledge 29/34. This operation is facilitated by the presence of guides and securing elements 83 (FIG. 4) provided in the cover 12.

It is pointed out that the cover 12, like the remaining elements, is preferably injection-molded of the desired synthetic resin.

The foregoing detailed description is to be clearly understood as given by way of illustration and example only, the spirit and scope of this invention being limited solely by the appended claims.

What is claimed is:

1. A shell for a domestic water cooler, which comprises:

(a) an elongate vertical front panel having left and right side edge portions that are substantially parallel to each other, (b) elongate left and right vertical side panels, each of said side panels having front and rear edge portions that are substantially parallel to each other, and (c) first and second corner joints to connect said front edge portions of said left and right side panels respectively to said left and right side edge portions of said front panel to cause said front panel and said side panels to be related to each other in U-shaped relationship as viewed in a horizontal plane, characterized in that said first corner joint is a slide joint that requires said front edge portion of said left side panel to slide longitudinally relative to said left edge portion of said front panel for at least the great majority of the length of said front panel in order to form said first corner joint, and further characterized in that said second corner joint is a slide joint that requires said front edge portion of said right side panel to slide longitudinally relative to said right edge portion of said front panel for at least the great majority of the length of said front panel in order to form said second corner joint.

2. The shell as claimed in claim 1, in which each of said panels is molded of synthetic resin.

3. The shell as claimed in claim 2, in which each of said panels is injection molded.

4. The shell as claimed in claim 1, in which each of said first and second corner joints is so constructed that said left and right side panels are convergent relative to each other, in a direction away from said front panel, after said first and second corner joints have been made and before said shell has been mounted on the frame of a water cooler, and in which said first and second corner joints are also so constructed that movement of said side panels in directions away from each other, during mounting of said shell on said frame, causes said corner joints when viewed from the exterior of said shell to appear to be more free of cracks than when said side panels are in the above-stated convergent relationship to each other.

5. The shell as claimed in claim 1, in which said front panels and said side panels have horizontal top edges, in which mounting means are provided to secure said rear edge portions of said side panels to the frame of a water cooler in parallel relationship to each other and at the same elevation as each other, and in which stop means are provided to prevent downward movement of said front panel relative to said side panels, past a predetermined position, while said side panels are secured by said mounting means to said frame, said predetermined position being such that top edges of said front panel and of said side panels are at the same elevation.

6. The shell as claimed in claim 1, in which mounting means are provided to secure said rear edge portions of said side panels to the frame of a water cooler in parallel relationship to each other.

7. The shell as claimed in claim 6, in which said mounting means comprises rear walls or flanges at said rear edge portions of said side panels, screw holes in said rear walls or flanges, and screws to pass through said screw holes and secure said rear walls or flanges to the frame of a water cooler.

8. The shell as claimed in claim 1, in which a water-cooler frame is provided, and in which said shell is mounted on and combined with said frame.

9. The shell as provided in claim 8, in which said shell is mounted on said frame by mounting means provided at said rear edge portions of said left and right side panels.

10. In a domestic water cooler, a shell assembly adapted to be assembled with a water-cooler frame, said shell assembly comprising:

(a) a first panel, (b) a second panel, said first and second panels being adapted to be parts of a shell of an assembled water cooler, and being adapted when thus parts of the assembled water cooler to be in a predetermined angular relationship to each other, (c) first joint means provided at one edge of said first panel, and (d) second joint means provided at one edge of said second panel, said first and second joint means being adapted to connect to each other, to join said first and second panels together, when said panels are at a second angular relationship to each other that is substantially different from said predetermined angular relationship, said first and second joint means having a crack therebetween that separates said first panel from said second panel, said first and second panels and said first and second joint means being such that said crack is substantial in width when said panels are at said second angular relationship, and is very small in width when said panels are at said predetermined angular relationship, whereby the panels when parts of the assembled water cooler are simulative of a unitary shell.

11. The domestic water cooler as claimed in claim 10, in which said panels and said joint means are such that panel portions at said crack pinch against each other for minimal crack width when said panels are at said predetermined angular relationship.

12. The domestic water cooler as claimed in claim 10, in which said first joint means and said second joint means are such that they may be connected to each other only by movement of said first and second panels relative to each other in a direction parallel to said crack.

13. A water cooler shell, comprising:

(a) a front panel section, (b) a right panel side section, (c) a left panel side section, and (d) first and second joint means to form joints between said front panel section and each of said right and left panel side sections, each of said first and second joint means comprising a tongue-in-groove connection between said front panel section and one of said panel side sections, each of said first and second joint means further comprising means to prevent the tongue portion and the groove portion of said tongue-in-groove connection from separating from each other, said means to prevent separation including contacting regions, one of which is on said front panel section, and the other of which is on said one of said panel side sections, and both of which are not in said tongue-in-groove connection.

14. The water cooler shell according to claim 13, in which said contacting regions are spaced from said tongue-in-groove connection.

15. The water cooler shell according to claim 13, in which said contacting regions include an elongate surface on said front panel section and that is parallel to said tongue-in-groove connection, and further include a surface of a flange on said one of said panel side sections and that is parallel to said tongue-in-groove connection.

16. The water cooler shell according to claim 15, in which said front panel section is injection-molded synthetic resin and has an elongate front panel that connects at a corner region to a flange that extends inwardly, said front panel section having means thereon, on the same side of said panel as said flange, to form an elongate surface parallel to said flange and that generally faces said flange, in which said one of said panel side sections is injection-molded synthetic resin and has an elongate side panel that has a groove-defining portion at a forward edge of said side panel, and which defines a groove to receive said flange when said one panel side section is transverse to said front panel section, said one panel side section having a flange that extends from said groove-defining portion to said elongate surface and that cooperates with said elongate surface to form said means to prevent said tongue and groove separation.

17. The water cooler shell according to claim 13, in which said front panel section has a faucet alcove, and in which the interior side wall of said alcove is one of said contacting regions.

18. The water cooler shell according to claim 15, in which said front panel section has a faucet alcove, and in which the interior side wall of said alcove is one of said elongate surface.

* * * * *